US009446438B2

(12) United States Patent
Cernuschi et al.

(10) Patent No.: US 9,446,438 B2
(45) Date of Patent: Sep. 20, 2016

(54) MANDREL HOLDER HEAD WITH RELEASE DEVICE

(75) Inventors: Ettore Cernuschi, Bareggio (IT); Stefano Deplano, Genoa (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 1956 days.

(21) Appl. No.: 12/225,754

(22) PCT Filed: Mar. 26, 2007

(86) PCT No.: PCT/EP2007/052885

§ 371 (c)(1),
(2), (4) Date: Aug. 1, 2011

(87) PCT Pub. No.: WO2007/110416

PCT Pub. Date: Oct. 4, 2007

(65) Prior Publication Data

US 2011/0277526 A1 Nov. 17, 2011

(30) Foreign Application Priority Data

Mar. 27, 2006 (IT) ..... MI2006A0562

(51) Int. Cl.
*B21B 25/02* (2006.01)
*B21B 25/00* (2006.01)
*B21B 25/06* (2006.01)

(52) U.S. Cl.
CPC ..... *B21B 25/02* (2013.01); *B21B 25/06* (2013.01)

(58) Field of Classification Search
CPC ..... B21B 25/00; B21B 25/06; B21B 17/00–17/12; B21B 25/02; B21C 25/08; B21C 25/04
USPC ..... 72/96, 97, 208, 209
See application file for complete search history.

(56) References Cited

U.S. PATENT DOCUMENTS 4,285,226 A * 8/1981 Gancia ..... 72/208
4,488,421 A 12/1984 Quecchia et al.

(Continued)

FOREIGN PATENT DOCUMENTS

EP 0 348 596 A2 1/1990
FR 1450997 A * 6/1966 ..... B21B 17/04

(Continued)

OTHER PUBLICATIONS

International Search Report based on PCT/EP2007/052885, Aug. 28, 2007.

*Primary Examiner* — Shelley Self
*Assistant Examiner* — Pradeep C Battula
(74) *Attorney, Agent, or Firm* — Abelman, Frayne & Schwab

(57) ABSTRACT

A mandrel holder head with release/fastening device of the mandrel for rolling metallic tubes comprises a mandrel holder (1) which accommodates within an internal seat a half collar (2) of externally cylindrical shape through an opening in the side wall. In the internal seat are accommodated both an end part (52) of the mandrel shank and the half collar (2) through the opening. The half collar has an internal cavity with a second longitudinal side opening which accommodates a second part (51) of the shank of diameter smaller than that of the first part (52). The half collar is divided along an axial direction into two cylindrical parts (21, 22) which have different diameters. The locking member (30, 31) of the half collar (2) holds it in the mandrel holder (1) seat in working conditions, while allowing shank release with an axial movement in locked conditions.

15 Claims, 4 Drawing Sheets

(56) References Cited

U.S. PATENT DOCUMENTS

| | | | | |
|---|---|---|---|---|
| 4,724,697 | A | 2/1988 | Hien et al. | |
| 5,062,199 | A * | 11/1991 | Kelly | 72/58 |
| 5,649,440 | A * | 7/1997 | Arnautu et al. | 72/96 |
| 7,024,909 | B2 * | 4/2006 | Cobzaru et al. | 72/393 |
| 7,437,904 | B2 * | 10/2008 | Katzenberger et al. | 72/391.2 |

FOREIGN PATENT DOCUMENTS

| | | | | |
|---|---|---|---|---|
| GB | 369163 | A * | 3/1932 | B21B 25/00 |
| JP | 61140311 | A | 6/1986 | |
| RU | 2351418 | C2 * | 4/2009 | |

* cited by examiner

MANDREL HOLDER HEAD WITH RELEASE DEVICE

PRIORITY CLAIM

Applicant claims priority under 35 U.S.C. §119, 120 and/or 365 based on PCT/IT2006/000562 having International Filing date 27 Mar. 2006 and Italian Application No. MI2006A0562 having filing date 27 Mar. 2006.

FIELD OF THE INVENTION

The present invention relates to a mandrel holder head with release device, in particular for weldless tube rolling mills.

BACKGROUND ART

Means for retaining the internal tool, hereinafter called mandrel, are present in retained mandrel longitudinal weldless tube rolling mills.

Weldless tube rolling mills generally comprise one or more motors controlling respective pinions which, in turn, engage a rack which moves forwards and backwards. Such rack is generally supported by wheels or other guiding systems, e.g. runners or the like. A mandrel holder head is rigidly connected to the rack in which the tail shank of the mandrel is accommodated.

Motors retain mandrel feed and allow feed at a speed, called retained speed, chosen according to technological needs.

During the normal rolling cycle, at each subsequent rolling run, the mandrel is replaced with a new mandrel by means of automatic systems, normally of the rotating arm type. Such systems lift the mandrel to be replaced once it has performed its function and the respective shank integral with it, from the mandrel holder head with motion essentially directed from the bottom upwards. Such automatic systems lower a new mandrel along with the shank replacing the first with a reversed motion directed from the top downwards into the mandrel holder head.

The retaining function of the shank in the mandrel holder head is achieved by means of an essentially "U"-shaped device which defines a groove in which an undercut is made in which the shank is arranged by clamping. This traditional equipment is generally called a "guillotine". The guillotine and the mandrel holder head are shaped so that the shank cannot be extracted with axial movement along the axis of the mandrel. A device of the prior art of this type is shown in FIG. 1 in section taken along an axial plane.

For accidental reasons, occasionally an unexpected interruption may occur and the rolling operation may not be completed due to causes of various type; consequently the rolling mill may stop with the machined tube still inside.

In such a situation, the mandrel which is still partially within the tube would in most cases be clenched by the tube itself and rigidly connected to the mandrel holder head. In such a case, resuming rolling mill operation would cause difficulties and delays, causing production downtime and hold-ups which have chain-effect repercussions on the rolling line.

An even more negative situation occurs in the case of severe jamming with the formation of unrolled material in excess in the spaces between cages, because the radial shift of the mandrel shank (5) to release the mandrel holder head (1) is essentially impossible, as there is no space for radial movements in transversal direction of the mandrel axis between mandrel holder head and shank.

Therefore a need is felt to make a mandrel holder head with release device which is very versatile in use and allows to overcome the aforesaid drawbacks.

SUMMARY OF THE INVENTION

It is the main objective of the present invention to make a mandrel holder head with release device, simple to make and which allows easy detachment between shank and mandrel holder head and which can be actuated also in particularly troublesome blockages of the rolling system.

The present invention therefore aims at reaching the objects illustrated above by means of a mandrel holder head with release/fastening device of a mandrel for rolling metallic tubes, comprising a first support member adapted to be moved by motor means and provided with an internal cavity with a first lateral opening, the internal cavity is adapted to accommodate a first end portion of the mandrel of transversal dimensions larger than those of second end part, characterised in that it comprises a second intermediate member adapted to cooperate with said first member, said internal cavity being adapted to accommodate the second member though said first opening and in that said second member defines an axis, has a second internal cavity with a second lateral opening oriented axially, is adapted to accommodate in said second end part of the mandrel, and is adapted to allow the extraction of said mandrel from said mandrel holder head in the axial direction.

The cylindrical shape of the external surface of the second half collar member allows a coupling between a first mandrel holder member and a second member of the type allowing a rotation about the axis of the second member. This allows the insertion of the second member in the internal cavity of the first member with a lateral movement followed by a rotation about its axis. It results the advantage that it is possible to remove the second member from the cavity of the first member also if the mandrel is clamped within a tube in turn jammed in a rolling mill.

The dependent claims describe preferred embodiments of the mandrel holder head according to the invention.

BRIEF DESCRIPTION OF THE DRAWINGS

Further features and advantages of the present invention will become apparent in the light of the detailed description of a preferred non-exclusive, embodiment, of a mandrel holder head with release device illustrated by means of a non-limiting example, with reference to the accompanying drawings, in which.

The same numerals and reference letters in the figures refer to the same elements.

DETAILED DESCRIPTION OF A PREFERRED EMBODIMENT OF THE INVENTION

Figure 1:
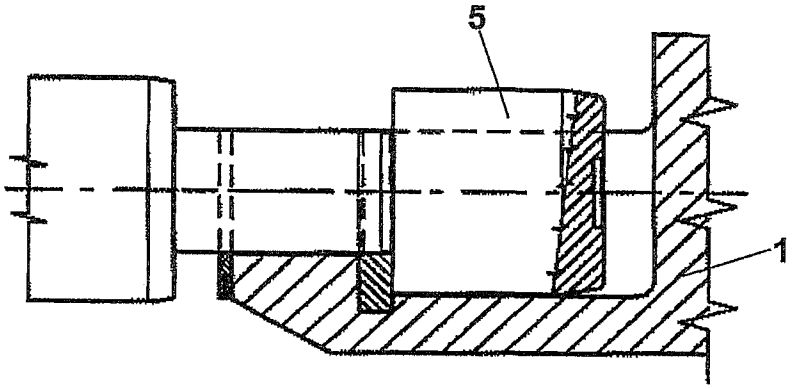
FIG. 1 PRIOR ART
FIG. 1 is a sectional view according to an axial plane of a mandrel holder head with release device according to the prior art.

Figures from 2 to 7 show a mandrel holder head 1 in locked position of the shank 10 and the respective mandrel integral with the latter.

The mandrel holder head 1 accommodates within the half collar 2 held in position by two stops 30 and 31 removably fastened to the head 1 by means of screws 41, 42, 43, 44 which are four by the way of example. This number may however be higher or lower than four.

Figure 2:
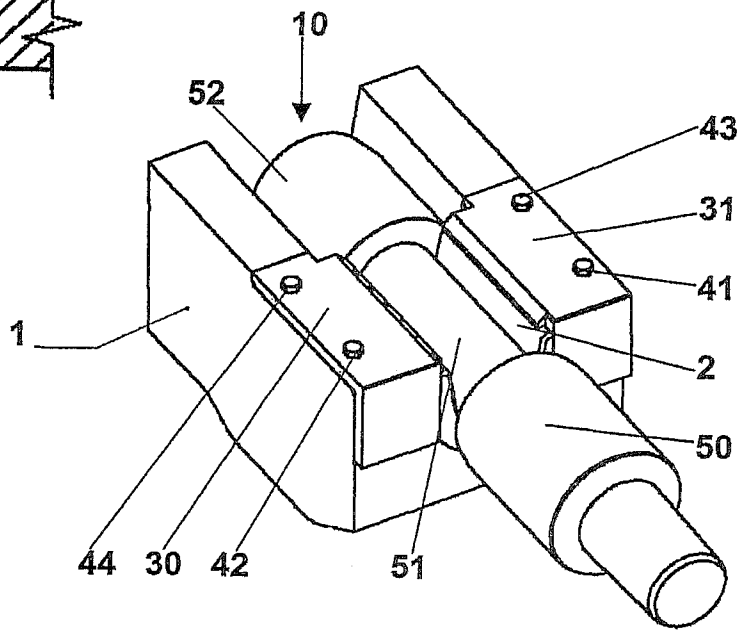
FIG. 2 shows an axonometric view of a mandrel holder head with release device according to the present invention.
Figure 5:
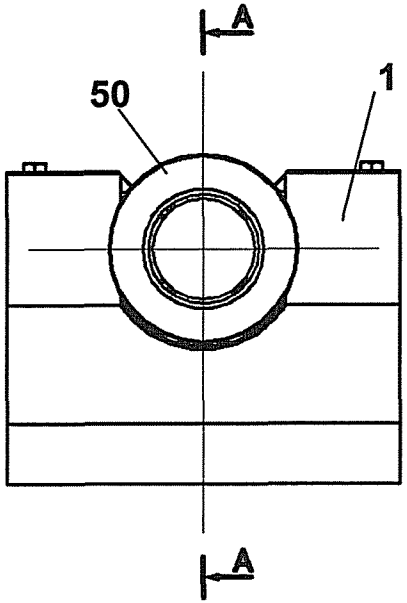
FIG. 5 is a view seen from the mandrel axis of the mandrel holder head in FIG. 2.
Figure 3:
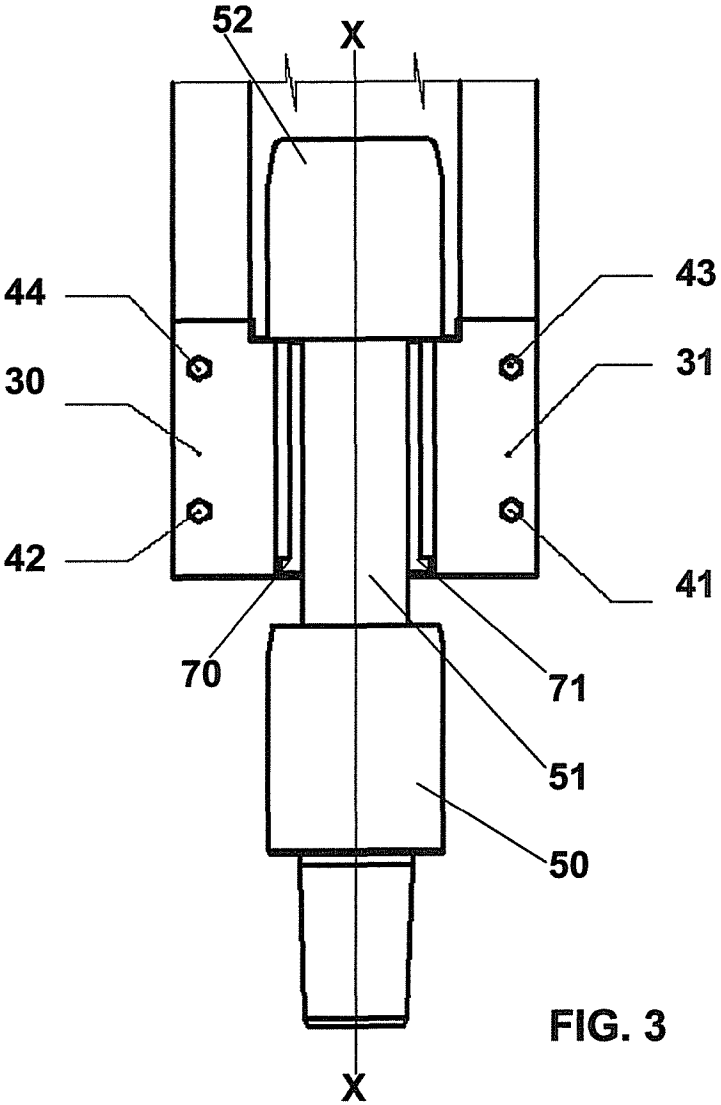
FIG. 3 is a lateral view of the mandrel holder head in FIG. 2.
Figure 4:
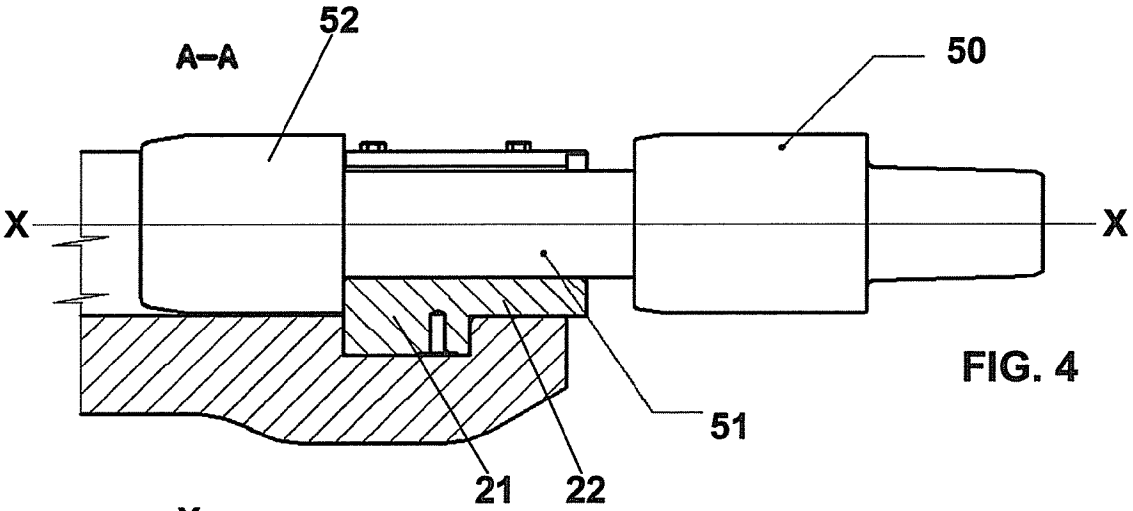
FIG. 4 is a sectional view taken on an axial plane A-A of the mandrel holder head in FIG. 2.
Figure 7:
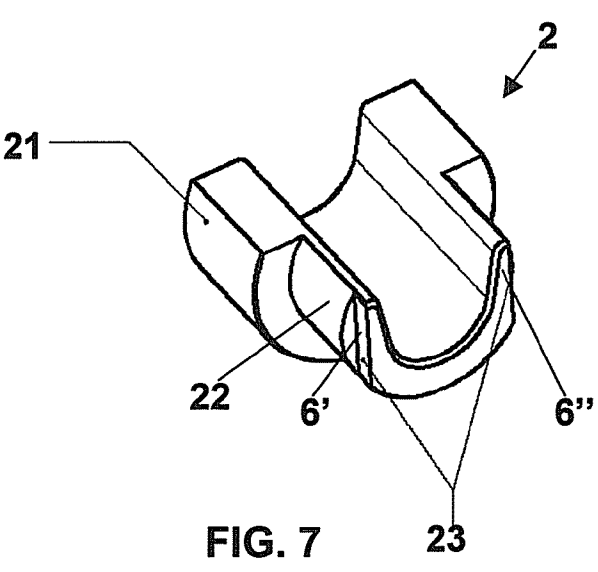
FIG. 7 is an axonometric view of a component of the mandrel holder head in FIG. 2 isolated from the mandrel holder head.
Figure 6:
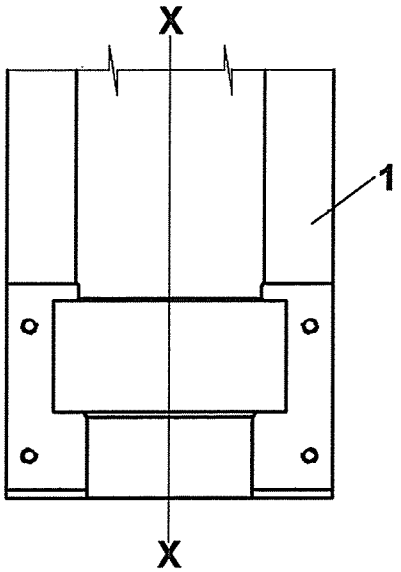
FIG. 6 is a lateral view of the mandrel holder head only.

As shown in FIGS. 2 and 3, the mandrel shank 10 is divided into three parts. Two parts 50 and 52 have a larger diameter and are separated by a third part 51 of smaller diameter. As shown in FIG. 7, the half collar 2 is divided into three zones along its axis. The half collar 2 is shaped so as to turn on an axis of rotation essentially coinciding with the X axis of the mandrel shank 10 (FIGS. 3, 4 and 6). The first cylindrical shape zone 21 is the one with the larger diameter and is the part which is interposed between the neck of the shank 51 and a complementarily shaped annular cavity of the mandrel holder head 1. The second cylindrical shape zone 22 has a smaller diameter than that of zone 21 and is arranged in axial direction after the first zone 21. This zone engages a corresponding seat, of complementary shape, arranged in the mandrel holder head 1. The third cylindrical shape zone 23 arranged by the side of zone 22 along the axis of the half collar is provided with flattened surfaces 6', 6", adapted to appropriately shaped tools so as to allow the rotation of the half collar 2 about its axis in case of need. Such flattened surfaces 6', 6" are made by way of example and may be replaced by other devices, such as holes or other without departing from the teaching of the invention.

The external diameter of the second zone 22 of the half collar 2 is advantageously larger than the diameter of the end portion 52 of shank 10. Thanks to such difference of diameter, after extracting the half collar 2 from the mandrel holder head 1 it is possible to axially release the shank 10 along the X axis.

The seat of the mandrel holder head 1, in which the half collar 2 is inserted, comprises "U" shaped sections along the X axis whose internal walls are shaped, at least on the part opposite the open side of the "U", with shapes complementary to the external shapes of the two zones 21, 22 into which the half collar 2 is divided.

The cylindrical shape of the external surface of the half collar 2 allows the rotation about the X axis, with associated circumferential sliding within the mandrel holder 1 during the fastening or release operation of the shank 10 of the mandrel holder 1.

As shown in FIG. 3, when the half collar 2 is in locked position of the shank 10, cavities 70, 71 remain in the part near the side of the half collar 2 corresponding to the opening of the "U" between the external surface of the cylindrical shape half collar 2 and the internal surface of the seat arranged in the flat shaped mandrel holder 1.

Two stops 30, 31 are provided to complete locking of the shank in the mandrel holder. These stops 30, 31 have various functions: to prevent lifting and rotation of the half collar 2, to limit infiltration and accumulation of dust, calamine, graphite or other in the cavities 70, 71.

Being the mechanical parts of the mandrel holder head heavily stressed, appropriate exhausts and unions, which do not modify the operation of the invention, are present.

In a variant of the invention, shank 10 may be either separate or integral with the mandrel.

Advantageously, on the lower part of the half collar 2 a threaded hole 8 (FIG. 8*c*) may be made to apply an eyebolt for lifting.

Figure 8B:
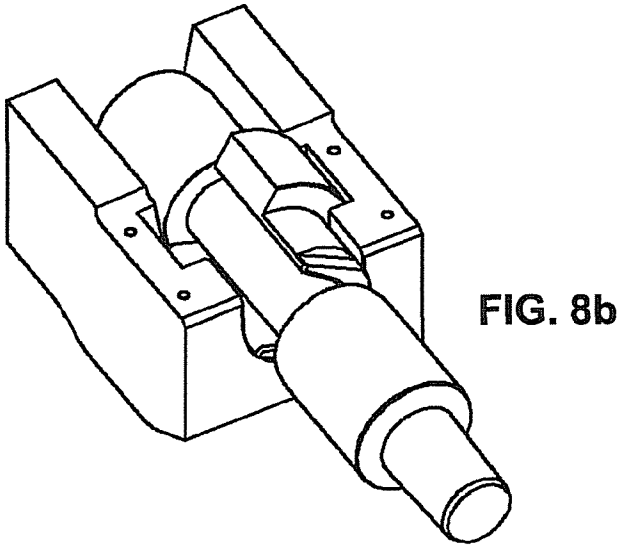
FIGS. 8*a*, 8*b*, 8*c*, 8*d* show assembly and disassembly steps of the mandrel shank in the mandrel holder head.
Figure 8D:
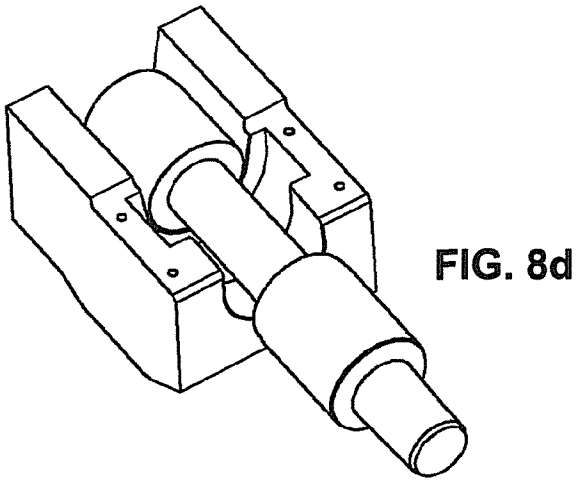
Figure 8A:
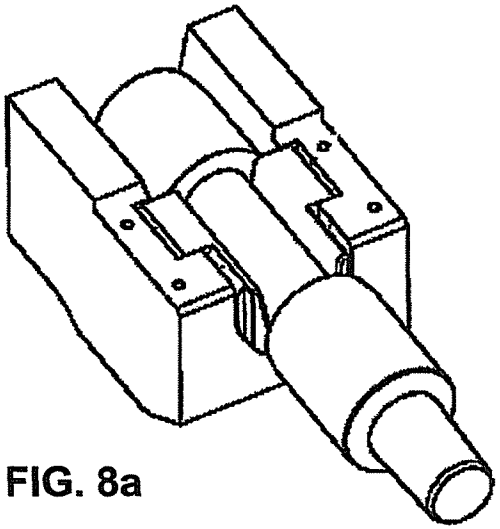
Figure 8C:
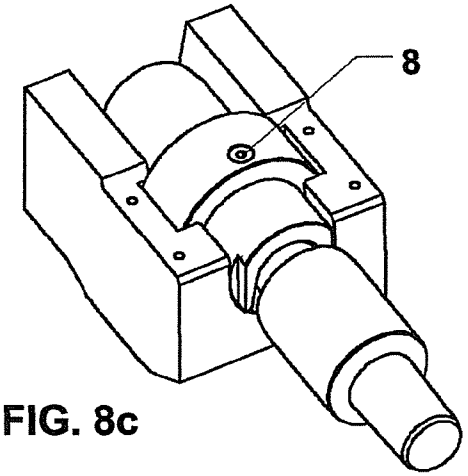

If the mandrel is jammed in the tube on the rolling mill and cannot be extracted, the mandrel holder head is released from the shank 10 using the following sequence of operations, with reference to FIGS. 2 and 8*a* . . . 8*d*. The stops 30, 31, are firstly released by removing the screws 40, 41, 42, 43 (FIGS. 2 and 8*a*) and in this way the half collar 2 is free to turn about its axis. By means of a tool with forces on the gripping surfaces 6', 6", the half collar is angularly turned sufficiently to place the opening of the "U" cavity towards the mandrel holder (FIGS. 8*b* and 8*c*). In such way, it is possible to extract the half collar 2 (FIG. 8*d*), also if the shank is still inserted in the mandrel holder head, making the half collar shift in transversal direction to the axis. Finally, the mandrel holder 1 may be removed with a movement related to the shank directed parallely to the X axis of the mandrel shank 10.

The invention claimed is:

1. A mandrel holder head adapted to releasably engage a mandrel used for rolling metallic tubes, where said mandrel has a first end part, having an outer diameter, an opposite end part having an outer diameter, and an intermediate part having an outer diameter, said outer diameters of said first and opposite end parts being greater than the outer diameter of said intermediate part, said mandrel holder head comprising:

a. a support member having a first cavity with a first lateral opening, said first cavity being adapted to receive said first end of the mandrel, and b. an intermediate member having a second internal cavity adapted to cooperate with said support member, said first cavity of said support member being adapted to receive said intermediate member where said cavities of said intermediate member and said support member have a common central axis, said intermediate member having said second cavity with a second lateral opening oriented axially that is adapted to accommodate said intermediate part of the mandrel, and being adapted to selectively restrain said mandrel in said mandrel holder head or to be rotated about said central axis to allow removal of said intermediate member transversely of said central axis from said support member, followed by extraction of said mandrel from said support member in the direction of said central axis.

2. The mandrel holder head according to claim 1, wherein said intermediate member has an external cylindrical shape that is divided along its axial direction into first and second portions, where the external diameter of the first portion is larger than the external diameter of the second portion, the first portion being provided with a locking member adapted to be releasably fastened to said support member, so as to prevent a release of the intermediate member through a first longitudinal opening in a first predetermined operating condition, or to allow the release the intermediate member through the first longitudinal opening in a second predetermined operating condition.

3. The mandrel holder head according to claim 2, wherein the intermediate member second portion comprises an end part that is engageable for rotation of said intermediate member about said central axis into said second predetermined operating condition for release of said intermediate member from said support member.

4. The mandrel holder head according to claim 2 wherein said locking member comprises two separate parts circumferentially separated from each other for engaging said intermediate member.

5. The mandrel holder head according to claim 1, wherein said first cavity and said second cavity, each having a U-shape in a section plane transverse to said central axis.

6. The mandrel holder head according to claim 5, wherein the shape of the first cavity of the support member is complementary to an external surface of said intermediate member so as to create a shape coupling between the support and intermediate members and so as to allow a rotational movement of the intermediate member with respect to the support member to allow a release/fastening operation of said intermediate member with respect to said support member.

7. The mandrel holder head according to claim 1, operable with a lifting device having an externally threaded stem, said intermediate member having a threaded hole adapted to be engaged by said threaded stem of said lifting device for lifting said intermediate member to be lifted away from said support member by said lifting device.

8. A mandrel holder head adapted to releasably engage a mandrel used for rolling metallic tubes, where said mandrel has a first end part, and an opposite end part where both parts have an outer diameter, and an intermediate part having an outer diameter less than the outer diameter of said first and opposite end parts, said mandrel holder head comprising:

a. a support member provided with a generally cylindrical first cavity with a first lateral opening along a central axis, said first cavity adapted to rotatably engage said first end part of said mandrel, and b. an intermediate member axially alignable with said support member and having a second cavity axially aligned with said first cavity and said second cavity adapted to receive said intermediate part of said mandrel, whereby said support member can selectively restrain said mandrel in said mandrel holder head or allow said intermediate member to be rotated about said central axis which allows removal of said intermediate member transversely of to said central axis from said support member and then allows extraction of said mandrel from said support member in the direction of the central axis.

9. The mandrel holder head according to claim 8 further comprising a locking member adapted to be removably fastened to said support member, so as to prevent release of said mandrel through said first lateral opening when fastened, and to allow extraction of said mandrel when unfastened.

10. The mandrel holder head according to claim 9 wherein said intermediate member comprises an end with a portion that is engageable for rotation of said intermediate member about its central axis into a predetermined operative condition to allow release of said intermediate member from said support member comprises a portion adapted to couple with a tool for applying a moment about the axis of the intermediate member.

11. The mandrel holder head according to claim 9 wherein said locking member comprises two separate parts circumferentially spaced apart from each other for engaging said intermediate member.

12. The mandrel holder head according to claim 8 wherein said first cavity and said second cavity, each having a U-shape in a section plane transverse to said central axis.

13. The mandrel holder head according to claim 12, wherein the shape of the first cavity of the support member is complementary to the external surface of said intermediate member so as to create a shape coupling between said support and intermediate members, and to allow rotational movement of said intermediate member with respect to said support member to allow a release/fastening operation of said intermediate member with respect to said support member.

14. The mandrel holder head according to claim 8 operable with a lifting device having an externally threaded stem, said intermediate member having a threaded hole adapted to be engaged by said threaded stem for lifting said intermediate member to be lifted away from said support member by said lifting device.

15. A mandrel holder head adapted to releasably engage a mandrel used for rolling metallic tubes, where said mandrel has a first end part having an outer diameter, an opposite end part having an outer diameter, and an intermediate part having an outer diameter, said outer diameters of said first and opposite end parts being greater than the outer diameter of said intermediate part, said mandrel holder head comprising:

a. a support member provided with a cavity with a first lateral opening on a top surface of said support member, the cavity being adapted to accommodate a said first end of the mandrel, and b. an intermediate member adapted to cooperate with said support member, said cavity of said support member being adapted to receive said intermediate member through a first longitudinal opening, said intermediate member and support member having a common central axis, said intermediate member having a second cavity with a second lateral opening oriented axially where said second lateral opening is adapted to engage said opposite end part of the mandrel, said support member and intermediate member being adapted to selectively restrain said mandrel in said mandrel holder head or to allow said intermediate member to be rotated about said central axis for removal of said intermediate member transversely to said central axis from said support member for extraction of said mandrel from said mandrel holder head in the direction of the central axis.

* * * * *